United States Patent [19]

DiGirolamo

[11] 4,107,636

[45] Aug. 15, 1978

[54] PLUG-IN ADAPTOR

[75] Inventor: John DiGirolamo, Orange, N.J.

[73] Assignee: Jerome Industries Corporation, Orange, N.J.

[21] Appl. No.: 798,971

[22] Filed: May 20, 1977

[51] Int. Cl.[2] ..... H01F 15/10; H01F 27/04

[52] U.S. Cl. ..... 336/92; 336/192; 336/198

[58] Field of Search ..... 336/192, 92, 105, 107, 336/198; 307/150; 363/146; 320/2

[56] References Cited

U.S. PATENT DOCUMENTS

| | | | |
|---|---|---|---|
| 3,387,244 | 6/1968 | Davis | 336/192 X |
| 3,403,366 | 9/1968 | Klatte et al. | 336/107 X |
| 3,711,806 | 1/1973 | Flentge | 336/198 X |
| 3,939,362 | 2/1976 | Grimes et al. | 336/107 |
| 4,028,654 | 6/1977 | Bullard et al. | 336/192 X |

*Primary Examiner*—Thomas J. Kozma
*Attorney, Agent, or Firm*—Nolte & Nolte

[57] ABSTRACT

A plug-in adaptor such as a power pack, transformer or the like in which the inner ends of the plug-in blades, which are connected to the primary, are mounted in molded channels integral with a flange of a coil bobbin, which flange is parallel to the coil length and a cover which encloses the flange and surrounds the blade ends, thus assisting in retaining the ends upon the flange at their connection to the primary and which is clamped to the transformer laminations by fingers extending from the lamination frame; and the bobbin has another extended area providing mounts for eyelets to which secondary leads and other components may be attached.

4 Claims, 4 Drawing Figures

PLUG-IN ADAPTOR

BACKGROUND OF THE INVENTION

Power packs of the type described for providing operating voltages for home operated calculators, cassette players and transcribers, electric razors and the like have become quite necessary, and various constructions relating to the transformer elements and plug-in blades of such power packs have been provided with the idea of providing safe and sturdy power packs and such packs which are easily assembled.

THE INVENTION

An object of the present invention is to provide a construction for a wall plug-in power pack in which the inner ends of the plug-in blades are located in molded channels on a flange extending in a plane parallel to the length of the coil of the transformer and in which the blades, resting in the channel, are easily attached to the magnet wire, used to wind the primary of the transformer.

It is a further object of the invention to provide a cover with slots for the blades and which completely encloses the blade ends at their connection to the primary as well as the shelf or flange upon which the blade ends rest within the molded channels or partitions, the cover being clamped to the transformer assembly just below the flange by finger elements of the transformer laminations frame to thereby enclose the primary ends so that they may not be contacted even if the transformer is plugged into a power outlet without the housing; and to thereby retain the blades in assembled position.

The invention also provides an extension of the bobbin in which holes are provided to receive eyelets to which the secondary leads and other electronic components may be attached; and thus, in which the terminals of the secondary winding are positioned for easy assembly to a secondary line chord.

Thus, the invention provides simplicity of construction to facilitate the assembly of the parts and to provide a safe assembly in which the primary terminals are positioned within a cover, which cover also maintains the plug-in blades in position.

The invention will be more clearly understood upon reading the following detailed disclosure taken in conjunction with the drawings in which.

Figure 1:
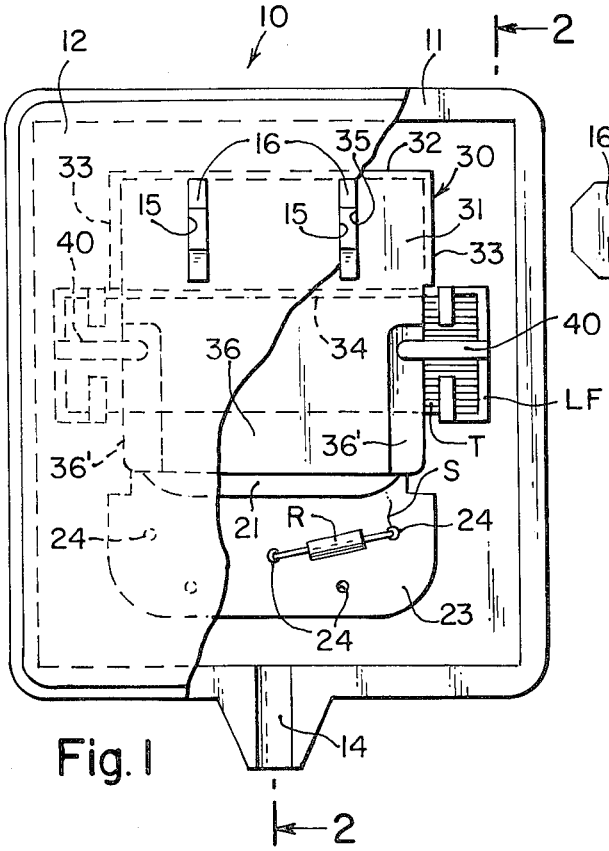
FIG. 1 is a front elevational view of a power pack with the front cover partially broken away to expose the inner assembly.

A power pack 10 in accordance with the invention comprises a rear cover 11 and front cover 12 which, in the present instance, are ultrasonically sealed along parting line 13 and which together form, at bottom portions thereof, a channel 14 for a secondary line chord (not shown).

The front cover provides at its upper portion slots 15 which accomodate plug-in blades 16 comprising the primary terminals which plug into a wall outlet.

Figure 4:
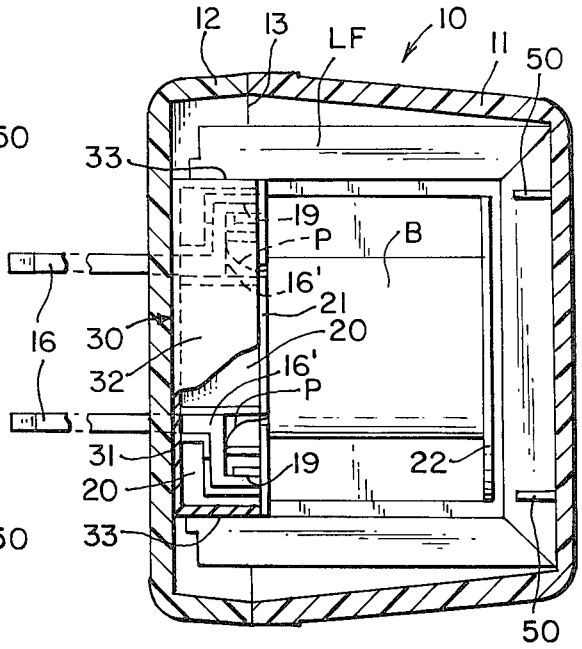
FIG. 4 is a sectional view taken along the lines 4—4 of FIG. 2 and partially broken away.

The inner ends 16' (FIG. 4) of the blades are angled to fit within channels 19, the walls of which are such with relation to the angled ends of the blades, that the blades sit within the channels and may be press fit therein, and in any event, are retained therein so that they may easily be connected to the ends of the primary winding P during assembly of the pack.

The walls of the channels are integrally formed with a shelf 20 which itself is integrally formed with the forward flange 21 of bobbin B around which the primary and secondary windings (not fully shown) are wound. The bobbin, is fabricated of an electerical insulating material.

Figure 2:
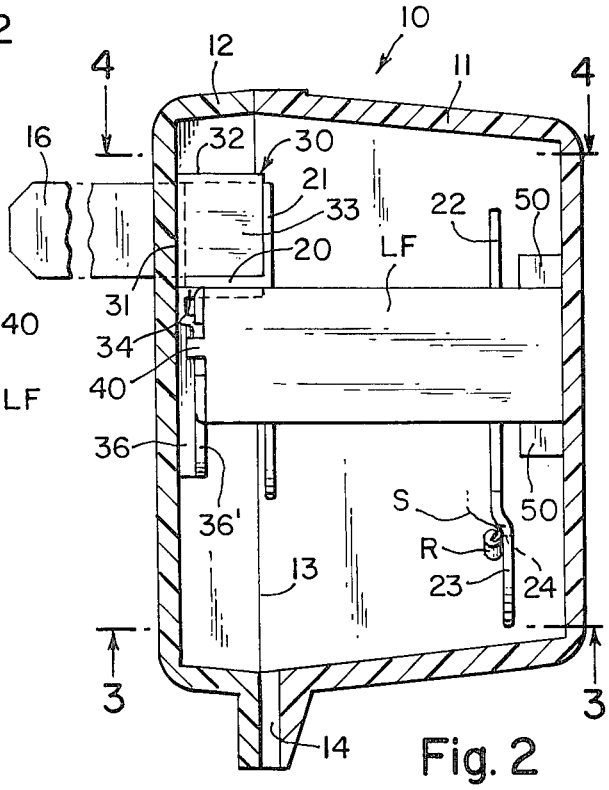
FIG. 2 is a sectional view taken along the lines 2—2 of FIG. 1.
Figure 3:
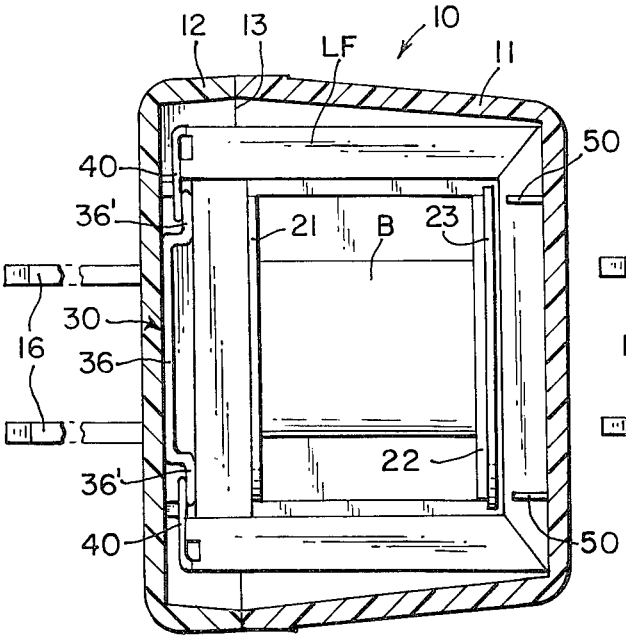
FIG. 3 is a sectional view taken along the lines 3—3 of FIG. 2.

The rearward flange 22 of the bobbin provides a lower extended portion 23 which is provided with holes 24 formed to receive metal eyelets to which secondary leads S (shown diagrammatically in FIGS. 1 and 2) and other electronic components such as resistor R may be attached, again, providing for a facile assembly.

A cover 30 which is also made of an electrical insulating material comprises a front wall 31, a top wall 32, side walls 33 and a bottom wall 34, all of which at the upper portion of the cover completely enclose the shelf 20 extending from the bobbin, the channels 19 and the inner ends of the blades 16. The front wall is provided with slots 35 which tightly fit around the blade 16 and which align with the slots 15 in the outer front cover of the power pack.

The bottom wall 34 fits directly beneath the shelf 20 and is in horizontal contact with the shelf. The top wall 32 is in contact with upper edges of blades 16 and the upper portions of channel 19, the construction being such that the inner ends of the blades are actually restrained by the cover in their positions within the channels.

The cover 30 has a lower portion 36 which extends downwardly in front of the transformer laminations T in which it is in contact at its outer indented edges 36'. Thus, the transformer laminations and the primary terminals are insulated, one from the other and from external touch, prior to assembly with the outer case, and after assembly, the cover lower portion 36 insulates the laminations from the front cover. Further when in assembly, the front cover 12 presses the front wall of the cover 30 against the transformer assembly and the latter against inner surfaces of the outer cover 11.

It should be understood that the construction of the bobbin may be as described, i.e., conventional as concerns having the primary and secondary wound one over the other so that only two flanges such as 21 and 22 need be provided; or a third flange (not shown) intermediate flanes 21 and 22 may be provided so that the primary can be wound next to the secondary.

Fingers 40 formed in the lamination frame LF bend inwardly over the indented edges 36' of the cover to retain the cover 30 against the transformer laminations.

The outer rear cover 11 is formed with lugs 50 between which the transformer frame fits and which together with the blades 16, held in place by cover 30 and by the tight fit of the slots 35 around the blades 16 and by the press fit of the lower portion 36 of cover 30 between the front outer cover 12 and transformer laminations, hold the transformer assembly within the housing and provide for facile assembly of the power pack of the invention.

Other modifications of the various structures above disclosed and described may, of course, be made without departing from the spirit of the invention.

I claim:

1. A power pack including a bobbin having spaced apart parallel flanges extending from a spindle, magnetic transformer means extending about said bobbin and through said spindle in planes parallel to said spindle, primary wall blades extending from said bobbin in planes parallel to said transformer means, and perpendicular to said flanges, an outer casing for said bobbin and transformer means and having slots to accommodate said primary wall blades and boss means adjacent rearward portions of said transformer means for holding said transformer means and bobbin against relative upward and downward movement, a shelf fabricated integrally with one of said flanges and extending substantially perpendicularly thereto and outwardly above said transformer means, channel means integrally formed in said shelf, said primary wall blades having inner ends constituting with said channels cooperating means for retaining said ends within said channels, a separate cover fitted over and covering said inner ends of said blades and said shelf, said cover having a front wall formed with slots fitted around said blades, a top and sides fitted over and on either side of said shelf and an apron extending continuously from said front wall in front of said tranformer means and below said blades, said cover constituting means for insulating and for further retaining said blade inner ends, said cover and said transformer means being fitted within said casing with said apron press fit between said casing and said transformer means to constitute with said boss means and said casing slots the only means for retaining the relative positions of said casing, said bobbin and transformer means and said cover.

2. The power pack of claim 1 wherein means extending from said transformer means are provided for securing said cover to said transformer means.

3. The power pack of claim 1, wherein said bobbin includes a portion continuously extending from another of said flanges below said bobbin and transformer means assembly, said portion being formed with means for securing secondary wires.

4. The power pack of claim 1, wherein said outer casing comprises rear and forward parts ultrasonically sealed along a parting line.

* * * * *